US007342466B2

(12) United States Patent
Benham

(10) Patent No.: US 7,342,466 B2
(45) Date of Patent: Mar. 11, 2008

(54) HYBRID COUPLER HAVING RESISTIVE COUPLING AND ELECTROMAGNETIC COUPLING

(75) Inventor: John R. Benham, Hopkinton, MA (US)

(73) Assignee: Intel Corporation, Santa Clara, CA (US)

( * ) Notice: Subject to any disclaimer, the term of this patent is extended or adjusted under 35 U.S.C. 154(b) by 101 days.

(21) Appl. No.: 11/201,613

(22) Filed: Aug. 10, 2005

(65) Prior Publication Data

US 2007/0035360 A1 Feb. 15, 2007

(51) Int. Cl.
*H01P 5/04* (2006.01)

(52) U.S. Cl. ..... 333/24 R; 333/117

(58) Field of Classification Search ..... 333/24 R, 333/109, 117

See application file for complete search history.

(56) References Cited

U.S. PATENT DOCUMENTS 6,449,308 B1 9/2002 Knight, Jr.
6,498,305 B1 12/2002 Marketkar
6,498,512 B2 12/2002 Simon et al.
6,533,586 B2 3/2003 Marketkar et al.
6,573,801 B1 6/2003 Benham
6,576,847 B2 6/2003 Marketkar
6,611,181 B2 8/2003 Marketkar
6,625,682 B1 9/2003 Simon et al.
6,661,269 B2 12/2003 Simon
6,665,624 B2 12/2003 Simon et al.
6,697,420 B1 2/2004 Simon
6,779,123 B2 8/2004 Simon et al.
6,788,163 B2 9/2004 Benham et al.
6,836,016 B2 12/2004 Marketkar et al.
6,887,095 B2 5/2005 Simon et al.
6,987,428 B2 1/2006 Marketkar
7,002,430 B2 2/2006 Benham et al.
7,068,120 B2 6/2006 Wu et al.
7,075,795 B2 7/2006 Wu
2001/0006538 A1 7/2001 Simon et al.
2001/0053187 A1 12/2001 Simon et al.
2002/0057136 A1 5/2002 Marketkar et al.
2002/0057137 A1 5/2002 Marketkar et al.
2002/0120880 A1 8/2002 Simon et al.
2002/0125039 A1 9/2002 Marketkar et al.
2003/0128079 A1 7/2003 Benham et al.
2003/0150642 A1 8/2003 Wu et al.
2003/0152153 A1 8/2003 Simon et al.
2003/0200346 A1 10/2003 Amirtharajah et al.
2003/0227346 A1 12/2003 Simon et al.
2003/0227347 A1 12/2003 Simon et al.
2003/0236005 A1 12/2003 Wu et al.
2004/0101060 A1 5/2004 Simon et al.
2004/0161051 A1 8/2004 Sun et al.
2004/0165677 A1 8/2004 Shen et al.
2004/0210688 A1 10/2004 Becker
2004/0239438 A1 12/2004 Benham et al.
2005/0025252 A1 2/2005 Tate et al.

(Continued)

OTHER PUBLICATIONS

John Benham, Electromatic Coupler with Direct Current Signal Detection, U.S. Appl. No. 11/165,982, filed Jun. 24, 2005.

*Primary Examiner*—Benny Lee

(57) ABSTRACT

In some embodiments, a hybrid coupler is provided with a resistive coupler to conductively tap a transmission line and an electromagnetic coupler to be disposed next to the transmission line to electromagnetically tap it. Other embodiments are disclosed herein.

32 Claims, 6 Drawing Sheets

U.S. PATENT DOCUMENTS

2005/0068885 A1 3/2005 Becker et al.
2005/0220213 A1 10/2005 Tate
2006/0290440 A1* 12/2006 Benham et al. ..... 333/24 R

* cited by examiner

HYBRID COUPLER HAVING RESISTIVE COUPLING AND ELECTROMAGNETIC COUPLING

BACKGROUND

Resistive and electromagnetic couplers are commonly used to probe signals such as logic signals. A resistive coupler is a device that when operated is in conductive contact with a transmission line to tap a signal passing through the transmission line. (As used herein the term: "tap" refers to acquiring, providing, or otherwise making available a signal off of a transmission line without unreasonably altering the signal. The term: "transmission line" refers to the material medium or structure that forms all or part of a path from one place to another for directing the transmission of one or more electrical signals. For example, a transmission line may comprise wires, traces, contacts, pins, circuit devices, and the like.) An electromagnetic (EM) coupler is a coupler that does not conductively contact a transmission line but instead is suitably positioned next to it to electromagnetically tap a signal in the transmission line.

FIG. 4 schematically shows a resistive coupler arrangement typical of contemporary techniques. A transmitter $T_x$ sends data (e.g., via a gigabit bit stream signal) to a receiver $R_x$. A resistive coupler 402 couples a sample of the signal to a resistive coupler receiver 406. With such a relatively high frequency signal, the resistance of the resistive coupler 402 is made sufficiently small to obtain a flat sampling of the signal components from the low frequency to the highest frequency components containing discernable energy. The bandwidth and signal to noise ratio constraints typically require that the resistance of the resistive coupler 402 be limited to a range of 200 to 400 ohms. Unfortunately, this can place an unreasonable energy loading on the circuit whose signal is being tapped.

FIG. 5 shows an EM coupled approach to sampling a logic signal arrangement typical of conventional techniques. An EM coupler 504 couples the signal from the transmission line (TL as shown in FIG. 4) to an electromagnetic coupler receiver 508. Termination resistors $R_T$ are included for impedance matching the EM circuit in order to enhance electromagnetic coupling. Due to the signal differentiation produced by the EM coupler, the receiver 508 is typically made to integrate the EM coupler signal in order to recover useful information corresponding to the waveform from the transmission line. As compared with a resistive coupler, it generally can be designed to draw less energy from the transmission line signal, but it may not provide lower frequency information, which can be useful in some applications.

Accordingly, an improved coupler approach may be desired.

BRIEF DESCRIPTION OF THE DRAWINGS

Embodiments of the invention are illustrated by way of example, and not by way of limitation, in the figures of the accompanying drawings in which like reference numerals refer to similar elements and may not be described in all drawing figures in which they appear.

DETAILED DESCRIPTION OF THE PREFERRED EMBODIMENTS

In some embodiments, a hybrid coupler with both a resistive and an EM coupler is provided. The EM coupler portion may be used to examine higher frequency components of a signal and thus, the resistive coupler portion may be designed to have less of an impact on a signal since it may not be required to examine the higher frequency components. While hybrid couplers disclosed herein may be useful for many different signal types, they may be used in some applications involving logic signals that include both high and low frequency components, e.g., wideband high frequency data components and low frequency static supervisory state durations. Furthermore, when implemented in a signal interface using differential signaling states, these low frequency supervisory states may also be both differential and non-differential, i.e. during the supervisory state the two signal lines of the differential interface maybe the normal 1's compliment or both may be asserted simultaneously to either a 1 or zero signal state. An example of such a signal is a clock-forwarded binary data signal with, e.g., a 5 gigabit/second data rate with embedded 50 ns or greater static supervisory state durations.

Figure 1:
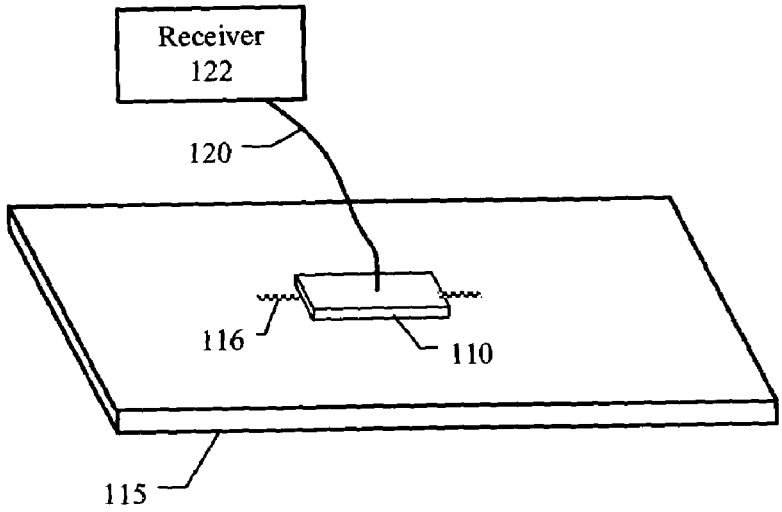
FIG. 1 shows a system with a hybrid coupler according to some embodiments of the invention.
Figure 2:
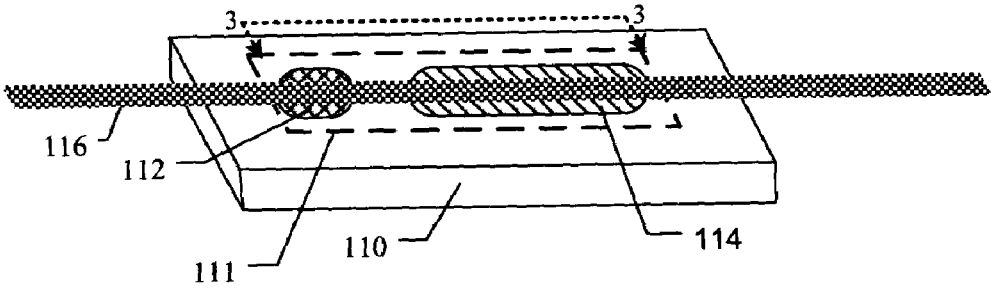
FIG. 2 is a perspective block representation of the underside of the hybrid coupler of FIG. 1.
Figure 3:
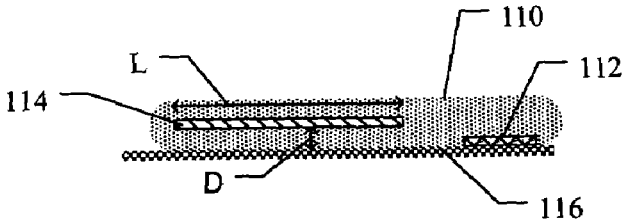
FIG. 3 is a side view of the hybrid coupler of FIG. 2 taken along line 3-3.
Figure 4:
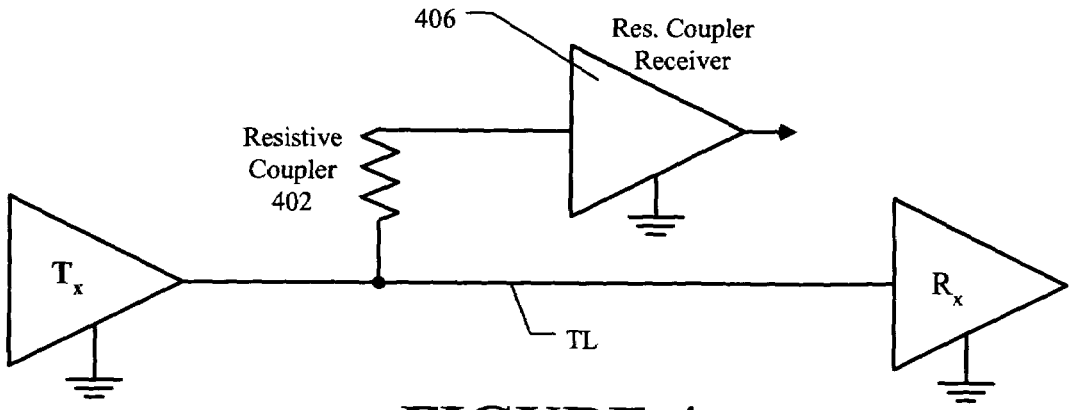
FIGURE 4 (Prior Art)
FIG. 4 is a schematic diagram of a conventional resistive coupler.
Figure 5:
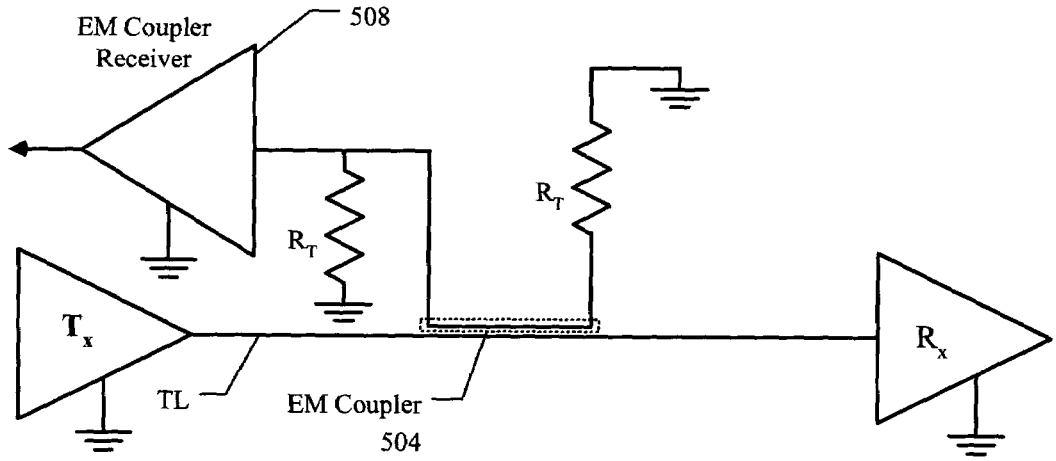
FIGURE 5 (Prior Art)
FIG. 5 is a schematic diagram of a conventional electromagnetic coupler.

With reference to FIGS. 1 to 3, a system with a probe 110 having a hybrid coupler may be used to probe signals carried on a transmission line 116. The signals carried on the transmission line 116 may be analog, digital, or combinations of analog and digital signals.

The transmission line 116 may be part of a digital circuit, for example, the transmission line may be a wire or conductive trace that is part of a circuit built from discrete components, a portion of which is on a surface 115, or a conductive feature that is part of a an integrated circuit chip. In addition, it may be part of a multi-conductor bus or of a non-bus conductor that connects two points of a circuit.

The probe 110 may be connected by a communication link 120 (e.g., a wire or cable or wirelessly) to a receiver 122, as shown in FIG. 1. The receiver may include circuitry that processes the probed signal to determine its characteristics and provides information about the characteristics, e.g., for use by analytical equipment or by a functional block in a system such as a memory interface in a computer system. The characteristics may be any arbitrary signal characteristics, such as the level of the signal, the locations of signal edges, or the duration of portions of the signal, for example. The receiver may be part of the probe or may be located a short distance from the probe.

FIG. 2 shows the underside of probe 110 and FIG. 3 is a side view of the probe taken along line 3-3. As indicated in the figures, probe 110 comprises a the hybrid coupler 111 (see FIG. 2) comprising a resistive coupler 112 and an electromagnetic (EM) coupler 114 (as shown in FIGS. 2 and 3). When the probe 110 is in use, the hybrid coupler 111 may be placed against the transmission line 116 so that the resistive coupler 112 is in conductive contact with the transmission line 116 and the EM coupler is positioned a suitable distance D proximal to it as shown in FIG. 3). Thus, the hybrid coupler 111 both conductively and electromagnetically couples the transmission line 116 signal to the receiver 122. Note that the EM coupler 114 need not be straight but could, for example, have a zigzag contour or have other configurations. (Additional information concerning EM couplers may be found, for example, in U.S. Pat. No. 6,573,801, entitled "Electromagnetic Coupler," U.S. patent application Ser. No. 09/797,637 (now U.S. Pat. No. 6,987, 428) entitled "Electromagnetic Coupler Flexible Circuit, "and U.S. patent application Ser. No. 10/077,684 now abandoned entitled "Signaling Through Electromagnetic Couplers.")

The proximity and orientation of the EM coupler 114 to the transmission line 116, and strength and other characteristics of the resulting coupling, may, in many cases, be somewhat unpredictable. Thus, the receiver 122 may be configured not to make any assumption about the characteristics of the coupling but rather to self-calibrate to accommodate the actual coupling characteristics that exist at a given time. In some implementations, a device such as a thin piece of plastic (such as with a flexible circuit) or a solder mask coating that exists on a printed circuit board can be used to control the distance D (FIG. 3) between the EM coupler 114 and the transmission line so that the degree of coupling will be somewhat predictable and consistent. In some embodiments, the probe 110 of FIGS. 1-3 corresponds to a hybrid coupler implemented with a flexible circuit. (It should be appreciated that the resistor and EM coupler portions may be in a separate housing or may be part of a common housing, as is indicated in FIGS. 1-3. For example, probe 110 may correspond to a housing comprising a flexible circuit to implement the resistor and EM coupler portions.

Figure 6:
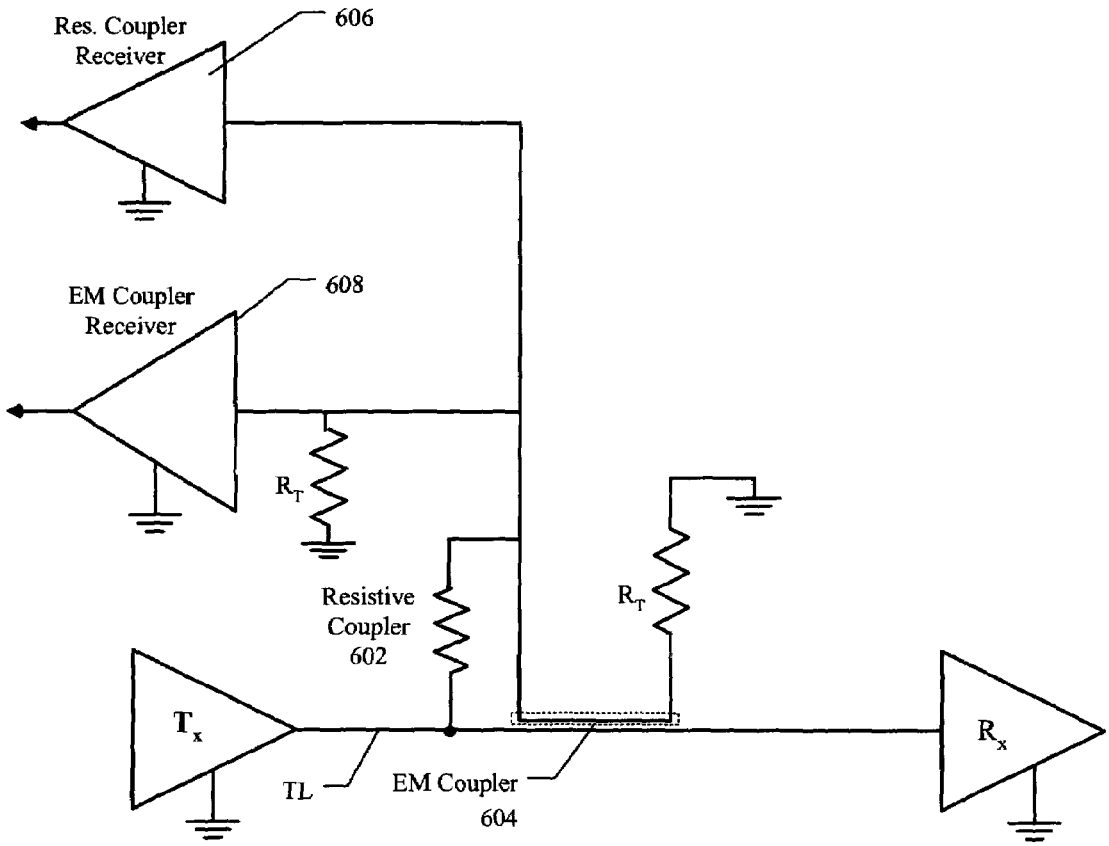
FIG. 6 is a schematic diagram of a hybrid coupler according to some embodiments of the invention.

FIG. 6 shows a hybrid coupler circuit according to some embodiments. The hybrid coupler circuit is suitable for use in a probe (such as a probe 110) or as part of a data acquisition (or recovery) system, for example, mounted with (on or in) a printed circuit board. The depicted hybrid circuit generally comprises a resistive coupler portion 602, EM coupler portion 604, a resistive coupler receiver 606, an EM coupler receiver 608, and termination resistors $R_T$ suitably disposed within the EM coupler circuit. As indicated, the resistive coupler circuitry 602/606 is essentially coupled in parallel to the EM coupler circuitry 604/608. The outputs from the receivers 606, 608 may be combined (e.g., downstream at a receiver) to indicate a resultant hybrid coupler signal, or they may be separately analyzed (or otherwise used).

The resistive coupler 602 may comprise any suitable (e.g., conventional) device although it's resistance need not be as small as would otherwise be required if resistive coupling were used alone. In some embodiments, it comprises a 600 to 800 ohm resistive coupling element. The resistive coupler receiver 606 comprises a lower frequency amplifier for observing the low frequency signal components. Since the resistive coupler receiver performs over a relatively small signal bandwidth, it can be designed with a correspondingly small noise bandwidth and therefore offer correspondingly high signal sensitivity performance.

The EM coupler portion may be implemented with any suitable EM coupler configuration. (Again, Additional information concerning EM couplers may be found, for example, in U.S. Pat. No. 6,573,801, entitled "Electromagnetic Coupler," U.S. patent application Ser. No. 09/797,637(now U.S. Pat. No. 6,987,428) entitled "Electromagnetic Coupler Flexible Circuit," and U.S. patent application Ser. No. 10/077, 684 now abandoned entitled "Signaling Through Electromagnetic Couplers.") As compared with the resistive coupler receiver 606, the EM coupler receiver 608 may comprise a wider-band integrating amplifier for observing the higher frequency signal components.

The geometric configuration of the coupling portion of the EM coupler 604, relative to a portion of the transmission line to be coupled, can be made to achieve a desired coupling coefficient response. For example, with reference back to FIG. 3, a coupling distance D may be selected to achieve a desired strength, while a length L may be selected to achieve a suitable frequency response over a desired operating band.

Figure 7:
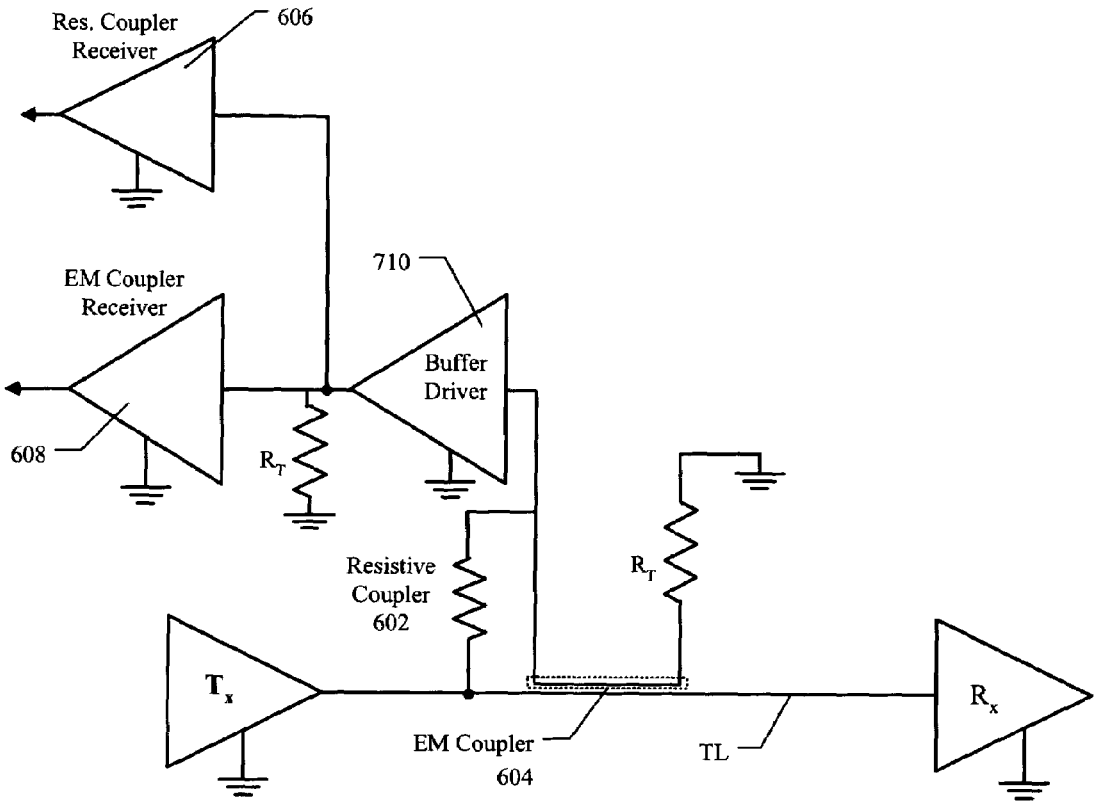
FIG. 7 is a schematic diagram of a hybrid coupler according to some other embodiments of the invention.

FIG. 7 shows another embodiment where a buffer or driver amplifier 710 is disposed in front of the EM coupler receiver 608 and resistive coupler receiver 606 in order, among other things, to reduce the amplifier input capacitive loading on the transmission line.

(Note that the transmission lines depicted and described may comprise one or more actual lines. That is, signals to be tapped may be single-ended, differential, or of other types. For simplicity sake, single line implementations have been shown, but the same techniques and circuits may be implemented with multiple, e.g., differential, lines. Separate couplers could be used for each line, with their output signals fed into either separate duplicative receiver circuitry or into appropriate common, differential circuitry.)

Figure 8:
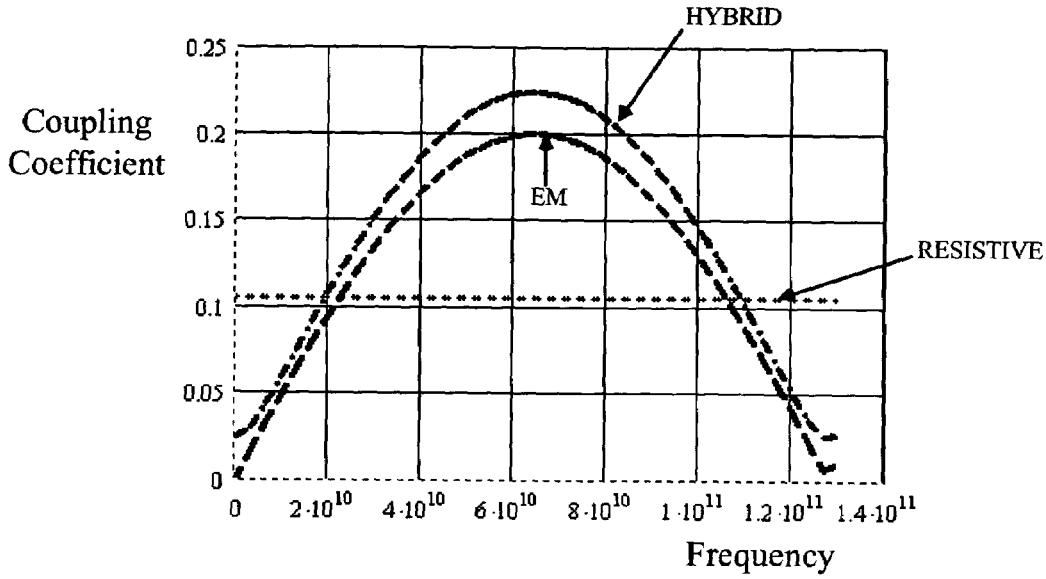
FIG. 8 is a graph showing coupling coefficient curves for a resistive, electromagnetic, and a hybrid coupler.
Figure 10:
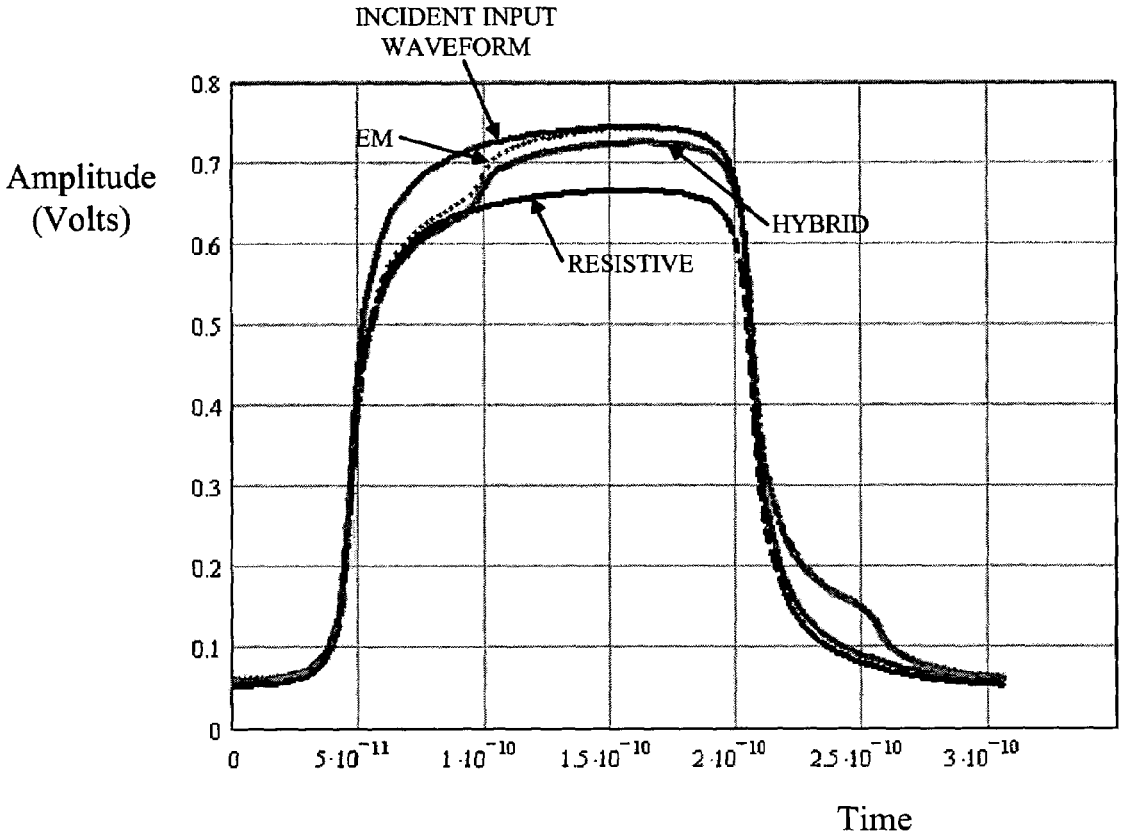
FIG. 10 is a graph showing the impact of resistive, electromagnetic and hybrid couplers on an incident signal.

FIG. 8 shows coupling coefficient curves and FIG. 10 shows impact curves on an incident input signal for a conventional resistive coupler (RESISTIVE), a conventional EM coupler (EM), and a hybrid coupler (HYBRID) according to some embodiments. As indicated, the resistive coupler has a relatively flat response, which is acceptable in most cases, except that in order to achieve adequate performance at higher frequencies, excessive loading may be exacted on the observed signal. On the other hand, the EM coupler provides strong coupling (at least over a limited frequency band) without excessive loading, but its coupling is frequency dependent, with an operating range centered about a given frequency (based on the physical and geometric characteristics of the EM coupler). Thus, it may operate suitably well with minimal loading over higher frequencies, but it generally couples poorly for lower frequency components.

The hybrid coupler response combines aspects of the resistive and EM couplers. It has a substantially frequency independent offset (attributable to the resistive coupling portion), along with a frequency dependent operating band attributable to the EM coupler portion. Thus, with less loading than a purely resistive solution (see FIG. 10), it can have suitable coupling for both lower and higher frequency components.

Figure 9:
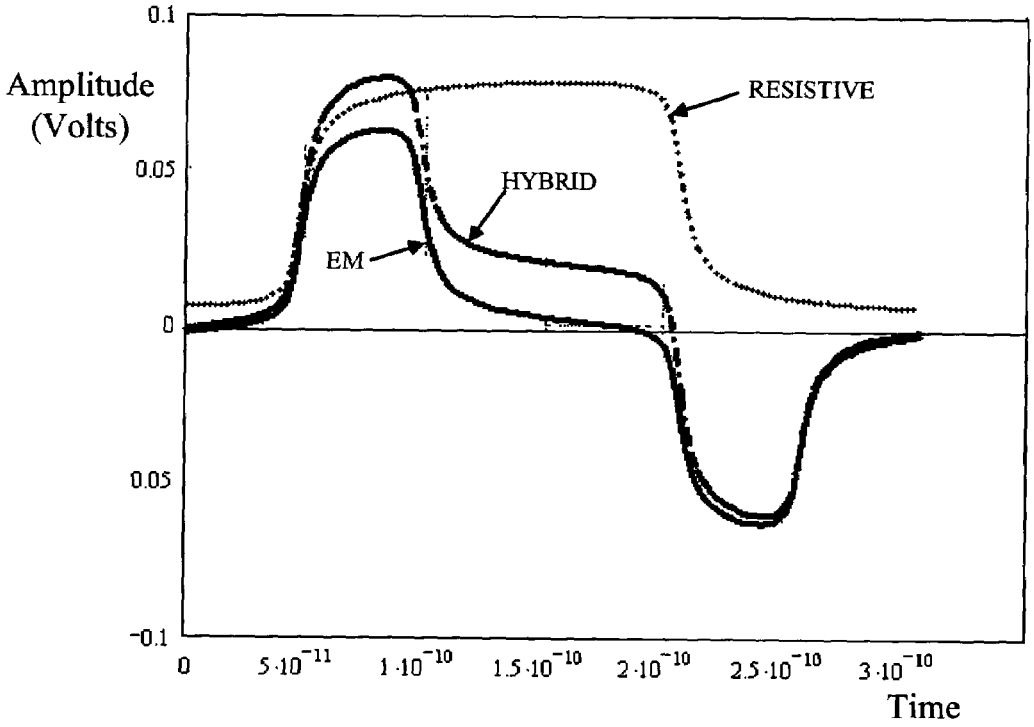
FIG. 9 is a graph showing signals acquired using a resistive, electromagnetic, and a hybrid coupler.

With reference to FIG. 9, signal waveforms are illustrated to compare coupler performance between a resistive (RESISTIVE), an electromagnetic coupler (EM), and a hybrid (HYBRID) coupler. These signals were calculated assuming the following parameters. The resistive coupler has a 400 ohm resistance resulting in a coupling coefficient of 0.1 with 50 ohm coupled circuits. The electromagnetic coupler uses a 150 mil. long structure totally immersed in FR4 (dielectric constant=4.0) with a maximum coupling coefficient of −13.9 dB at 6 GHz. The hybrid coupler uses the same EM coupler for its EM coupler portion and uses a resistive coupler with a resistance of 2,000 ohms. As seen in the graphs, the EM coupler output signal indicates when the observed signal transitions from one logic level to another but fails to indicate information about the signal at non transition times. This can be problematic such as if the observed signal stays at a given level (e.g., stays at a "1") for an extended period of time, the EM integrator may saturate, or it simply might fail to provide relevant information (e.g., positive or negative) about the signal. The signal from the resistive coupler conveys this information, but again it may have an adverse loading impact on the signal. However, the hybrid coupler, without having such an impact on the signal, provides transition information like the EM coupler and in addition, provides information about the signal at non-transition times (e.g., is it positive, negative, or at 0). Thus, the hybrid coupler may be used to observe relatively high and low frequency components in a high frequency signal without excessively loading the signal being tapped.

Examination of the coupler output waveforms of FIG. 9 shows that the EM and Hybrid couplers only extract significant power from the signal waveform during the time when the input signal is transitioning its logical state. The duration of the output pulses produced by the EM and Hybrid couplers as shown in FIG. 9 is equal to twice the propagation delay along the EM coupler portion of the device. The impact of this time varying power extraction behavior of the EM and Hybrid couplers on the observed waveform is illustrated in FIG. 10, which shows incident input waveforms to the three different couplers . A receiver measuring the pulse waveforms of FIG. 10 is normally adjusted to sample the signal state at a time around the mid point of the pulse in order to minimize the detected bit error rate. By selecting an appropriate electrical length for the EM coupler component the impact of the Hybrid probe on the mid-point of the pulse can be minimized. However the coupler component should be sufficiently long to ensure the output pulses have sufficient energy content to allow the EM coupler receiver to integrate and resolve the data signal with an adequately low error probability.

It should be appreciated that embodiments of hybrid couplers disclosed herein may be used in a variety of applications and environments. For example, they could be used with a receiver such as receiver 122 (see FIG. 1) with analytical equipment that may be designed and configured for particular applications. In some cases, when the characteristics of the signals carried on the transmission line (and of the data carried on the signals) are known or suspected in advance, the circuitry and software included in the receiver and analytical equipment may be designed to analyze the expected signals and data. In other cases, when the characteristics of the signals and data may not be known in advance, the circuitry and software could have broader, more general capabilities to infer those characteristics.

The analytical equipment may, among other things, derive the data embedded in the signal that is carried on a transmission line and detected through a probe. However, in some implementations, the analytical equipment may not derive the data for the purpose of receiving and using the information that the data represents. Rather, the derived data may be used for other purposes such as testing or debugging of a circuit. The analytical equipment may output data for use in other equipment not shown. The other equipment may include computers of the kind used to analyze the outputs of typical automated test equipment. For example, the derived data may be used in the testing of a circuit without requiring "real estate" to be dedicated in the usual way to test pads at which direct probe connections would be made.

While the inventive disclosure has been described in terms of several embodiments, those skilled in the art will recognize that the invention is not limited to the embodiments described, but can be practiced with modification and alteration within the spirit and scope of the appended claims. Moreover, it should be appreciated that example sizes/models/values/ranges may have been given, although the present invention is not limited to the same. As manufacturing techniques mature over time, it is expected that devices of smaller size could be manufactured. With regard to description of any timing or programming signals, the terms "assertion" and "negation" are used in an intended generic sense. More particularly, such terms are used to avoid confusion when working with a mixture of "active-low" and "active-high" signals, and to represent the fact that the invention is not limited to the illustrated/described signals, but can be implemented with a total/partial reversal of any of the "active-low" and "active-high" signals by a simple change in logic. More specifically, the terms "assert" or "assertion" indicate that a signal is active independent of whether that level is represented by a high or low voltage, while the terms "negate" or "negation" indicate that a signal is inactive. In addition, well known power/ground connections to IC chips and other components may or may not be shown within the figures for simplicity of illustration and discussion, and so as not to obscure the invention. In addition two hybrid couplers may be juxtaposed to sample the complimentary signals available on a differential signal interface, in which case both the resistive coupler and EM coupler receivers can be implemented as differential circuits to observe the state of the differential signal interface. Further, arrangements may be shown in block diagram form in order to avoid obscuring the invention, and also in view of the fact that specifics with respect to implementation of such block diagram arrangements are highly dependent upon the platform within which the present invention is to be implemented, i.e., such specifics should be well within purview of one skilled in the art. Where specific details (e.g., circuits) are set forth in order to describe example embodiments of the invention, it should be apparent to one skilled in the art that the invention can be practiced without, or with variation of, these specific details. The description is thus to be regarded as illustrative instead of limiting.

What is claimed is:

1. An apparatus, comprising:

a resistive coupler to conductively contact a transmission line having a signal to provide a portion of the signal;

an electromagnetic coupler to be disposed proximal to the transmission line to provide a different portion of the signal; and an integrating driver coupled to the electromagnetic coupler to integrate the different portion of the signal.

2. The apparatus of claim 1, in which the resistance of the resistive coupler is in excess of about 600 ohms.

3. The apparatus of claim 1, in which the signal portions from the resistive and electromagnetic couplers are to be combined to provide a resultant signal.

4. The apparatus of claim 1, in which the resistive coupler, electromagnetic coupler and transmission line are mounted in a common printed circuit board.

5. The apparatus of claim 1, in which the resistive and electromagnetic couplers are coupled to one another.

6. The apparatus of claim 1, in which the transmission line is to carry a gigabit logic signal with lower frequency components of interest.

7. The apparatus of claim 1, in which the resistive and electromagnetic couplers are housed in a common probe housing.

8. The apparatus of claim 7, in which the common probe housing comprises a flexible circuit.

9. A hybrid coupler, comprising:

at least one resistive coupler to conductively tap a transmission line;

at least one electromagnetic coupler to be disposed next to the transmission line to electromagnetically tap said transmission line, and an integrating driver coupled to the electromagnetic coupler to integrate a signal output therefrom.

10. The hybrid coupler of claim 9, in which the resistive and electromagnetic couplers are housed in a common probe housing.

11. The hybrid coupler of claim 10, in which the common probe housing comprises a flexible circuit.

12. The hybrid coupler of claim 9, in which the outputs from the resistive and electromagnetic couplers are coupled to provide a resultant signal.

13. The hybrid coupler of claim 9, in which the resistance of the resistive coupler is in excess of about 600 ohms.

14. The hybrid coupler of claim 9, in which the resistive and electromagnetic couplers are coupled to one another.

15. The hybrid coupler of claim 9, in which the transmission line is to carry a gigabit logic signal with lower frequency components.

16. The hybrid coupler of claim 9, in which the resistive coupler, electromagnetic coupler and transmission line are mounted with a common printed circuit board.

17. A system comprising:

a hybrid coupler comprising a resistive coupler to conductively tap a transmission line in a circuit board and an electromagnetic coupler to be disposed next to the transmission line to electromagnetically tap said transmission line; and a receiver coupled to the hybrid coupler to receive a signal tapped from the transmission line, the receiver comprising an integrating driver coupled to the electromagnetic coupler to integrate a signal output therefrom.

18. The system of claim 17, in which the resistive coupler has a resistance in excess of about 600 ohms.

19. An apparatus, comprising:

a resistive coupler to conductively contact a transmission line having a signal to provide a portion of the signal; and an electromagnetic coupler to be disposed proximal to the transmission line to provide a different portion of the signal, wherein the resistive and electromagnetic couplers are housed in a common probe housing comprising a flexible circuit.

20. The apparatus of claim 19, in which the resistive and electromagnetic couplers are coupled to one another.

21. The apparatus of claim 19, in which the transmission line is to carry a gigabit logic signal with lower frequency components of interest.

22. The apparatus of claim 19, in which the resistive coupler, electromagnetic coupler and transmission line are mounted in a common printed circuit board.

23. The apparatus of claim 19, in which the resistance of the resistive coupler is in excess of about 600 ohms.

24. The apparatus of claim 19, in which the signal portions from the resistive and electromagnetic couplers are to be combined to provide a resultant signal.

25. The apparatus of claim 19, comprising an integrating driver coupled to the electromagnetic coupler to integrate the different portion of the signal.

26. A hybrid coupler, comprising:

at least one resistive coupler to conductively tap a transmission line; and at least one electromagnetic coupler to be disposed next to the transmission line to electromagnetically tap said transmission line, wherein the resistive and electromagnetic couplers are housed in a common probe housing comprising a flexible circuit.

27. The hybrid coupler of claim 26, in which the resistive and electromagnetic couplers are coupled to one another.

28. The hybrid coupler of claim 26, in which the transmission line is to carry a gigabit logic signal with lower frequency components.

29. The hybrid coupler of claim 26, in which the resistive coupler, electromagnetic coupler and transmission line are mounted with a common printed circuit board.

30. The hybrid coupler of claim 26, in which the resistance of the resistive coupler is in excess of about 600 ohms.

31. The hybrid coupler of claim 26, in which the outputs from the resistive and electromagnetic couplers are coupled to provide a resultant signal.

32. The hybrid coupler of claim 26, comprising an integrating driver coupled to the electromagnetic coupler to integrate a signal output therefrom.

* * * * *